US007768510B2

(12) United States Patent
Tsai et al.

(10) Patent No.: US 7,768,510 B2
(45) Date of Patent: Aug. 3, 2010

(54) MEASUREMENT DEVICE FOR MEASURING GRAY-TO-GRAY RESPONSE TIME

(75) Inventors: Tsung-Yi Tsai, Hsinchu County (TW); Tsung-Yu Tsai, Hsinchu (TW); Yi-Fan Chen, Taichung (TW)

(73) Assignee: Mstar Semiconductor, Inc., Hsinchu Hsien (TW)

( * ) Notice: Subject to any disclaimer, the term of this patent is extended or adjusted under 35 U.S.C. 154(b) by 951 days.

(21) Appl. No.: 11/586,650

(22) Filed: Oct. 26, 2006

(65) Prior Publication Data

US 2007/0176871 A1 Aug. 2, 2007

Related U.S. Application Data

(60) Provisional application No. 60/762,532, filed on Jan. 27, 2006.

(51) Int. Cl.
*G09G 5/00* (2006.01)

(52) U.S. Cl. ..... 345/207

(58) Field of Classification Search ..... 345/207; 348/189

See application file for complete search history.

(56) References Cited

U.S. PATENT DOCUMENTS 7,262,818 B2 * 8/2007 Chuang et al. ..... 348/790
2006/0227249 A1 * 10/2006 Chen et al. ..... 348/631

FOREIGN PATENT DOCUMENTS

CN 1673810 A 9/2005

* cited by examiner

*Primary Examiner*—Richard Hjerpe
*Assistant Examiner*—Carolyn R Edwards
(74) *Attorney, Agent, or Firm*—Birch, Stewart, Kolasch & Birch, LLP

(57) ABSTRACT

The present invention discloses a measurement device for measuring the gray-to-gray response time. The measurement device is capable of precisely measuring the gray-to-gray response time of an LCD. According to a video signal comprising a synchronous message, the measurement device obtains the initial time and the final time of each gray-to-gray response time interval in the transition of LCD luminance, so as to achieve synchronous measurement of the LCD gray-to-gray response time.

18 Claims, 6 Drawing Sheets

MEASUREMENT DEVICE FOR MEASURING GRAY-TO-GRAY RESPONSE TIME

This Nonprovisional application claims priority under 35 U.S.C. §119(e) on U.S. Provisional Application No(s). 60/762,532 filed on Jan. 27, 2006, the entire contents of which are hereby incorporated by reference.

BACKGROUND OF THE INVENTION

1. Field of the Invention

The present invention generally relates to a measurement device and, more particularly, to a measurement device for measuring the gray-to-gray response time of a liquid crystal display (LCD).

2. Description of the Prior Art

For a liquid crystal display (LCD), the response time indicates the transition from a frame to another as the alignment of liquid crystal molecules changes. The response time affects the LCD video quality for motion pictures, especially for pictures in which objects are moving at a high speed. If the response time is slow, it is easy that image blur occurs. Typically, the response time is measured in milliseconds (ms, 1/100 second) to indicate the transition from a full black/white frame to a full white/black frame, i.e., the black-and-white transition. However, in practical uses, a frame seldom changes from black/white to full white/black. Instead, the frequency of gray-to-gray transitions is typically far greater than black-and-white transitions.

The gray-to-gray response time is defined by choosing two gray levels G1 and G2, wherein G1<G2. The rise time (Tr) is referred to as the transition time wherein the luminance rises from 10% to 90% during the G1-to-G2 transition, and the fall time (Tf) is referred to as the transition time wherein the luminance falls from 90% to 10% during the G2-to-G1 transition. The gray-to-gray response time for transition between G1 and G2 is the sum of the rise time and the fall time, i.e., Tr+Tf.

Since the gray-to-gray response time is measured using tested pictures with different gray levels G1 and G2 to be switched based on the same time interval. The luminance at the center of the display is measured by a measurement device so as to analyze the response time during the transition. Therefore, in the minimal range of optical variation, interference due to noise often leads to inaccuracy in gray-to-gray response time measurement. However, it is crucial to precisely measure the gray-to-gray response time because the image quality of the LCD significantly relies on the gray-to-gray response time. Thus, considering the follow-up image processing, it is very helpful to obtain accurate data of the gray-to-gray response time.

SUMMARY OF THE INVENTION

It is the primary object of the present invention to provide a measurement device for precisely measuring the gray-to-gray response time of a liquid crystal display (LCD).

It is the secondary object of the present invention to utilize a synchronous message to obtain the initial time and the final time of each gray-to-gray response time interval in the transition of LCD luminance so as to achieve synchronous measurement of the LCD gray-to-gray response time.

In order to achieve the foregoing objects, the present invention provides a measurement device for measuring the gray-to-gray response time of a liquid crystal display (LCD), the measurement device comprising: a signal generating unit, a data processing unit and a data acquisition unit. The signal generating unit generates a video signal comprising a synchronous message. The data processing unit is coupled to the signal generating unit for recording the synchronous message and controlling the LCD to generate an optic signal according to the video signal. The data acquisition unit is coupled to the data processing unit for converting the optic signal into a digital data so that the data processing unit measures the gray-to-gray response time of the LCD according to the synchronous message and the digital data.

It is preferable that the synchronous message is a vertical synchronous signal.

It is preferable that the data processing unit comprises: an I/O interface, a scaler, a micro-controller and a memory. The I/O interface is used for signal inputting or outputting. The scaler performs a scaling operation on the video signal. The micro-controller generates a sampling command capable of being synchronized with the synchronous message according to the synchronous message. The memory stores the synchronous message and the digital data.

It is preferable that the data acquisition unit comprises: an optic sensor, a current-voltage converter, a gain amplifier and an analog-to-digital converter. The optic sensor senses the optic signal and converts the optic signal into a current signal. The current-voltage converter converts the current signal into a voltage signal. The gain amplifier amplifies the voltage signal. The analog-to-digital converter converts the voltage signal into the digital data according to the sampling command.

In order to achieve the foregoing objects, the present invention provides a measurement device for measuring the gray-to-gray response time of a liquid crystal display (LCD), the measurement device comprising: a micro-controller, a scaler, a data acquisition unit and an analog-to-digital converter. The micro-controller generates a sampling command capable of being synchronized with a synchronous message according to a video signal comprising the synchronous message. The scaler performs a scaling operation on the video signal so as to control the LCD to generate an optic signal. The data acquisition unit processes a signal recording information of the optic signal so as to output an electric signal. The analog-to-digital converter converts the electric signal into a digital data according to the sampling command.

It is preferable that the synchronous message is a vertical synchronous signal. The video signal comprising the synchronous message is generated from a computer. The signal recording information of the optic signal is generated from an optic sensor.

It is preferable that the data acquisition unit comprises: a current-voltage converter and a gain amplifier. The current-voltage converter converts the signal recording information of the optic signal into the electric signal. The gain amplifier amplifies the electric signal.

It is preferable that the measurement device for measuring the gray-to-gray response time of an LCD further comprises a memory for storing the synchronous message and the digital data.

BRIEF DESCRIPTION OF THE DRAWINGS

The objects, spirits and advantages of the preferred embodiments of the present invention will be readily understood by the accompanying drawings and detailed descriptions, wherein.

DETAILED DESCRIPTION OF THE PREFERRED EMBODIMENT

The present invention discloses a measurement device for measuring the gray-to-gray response time of a liquid crystal display and can be exemplified by the preferred embodiments as described hereinafter.

Figure 1:
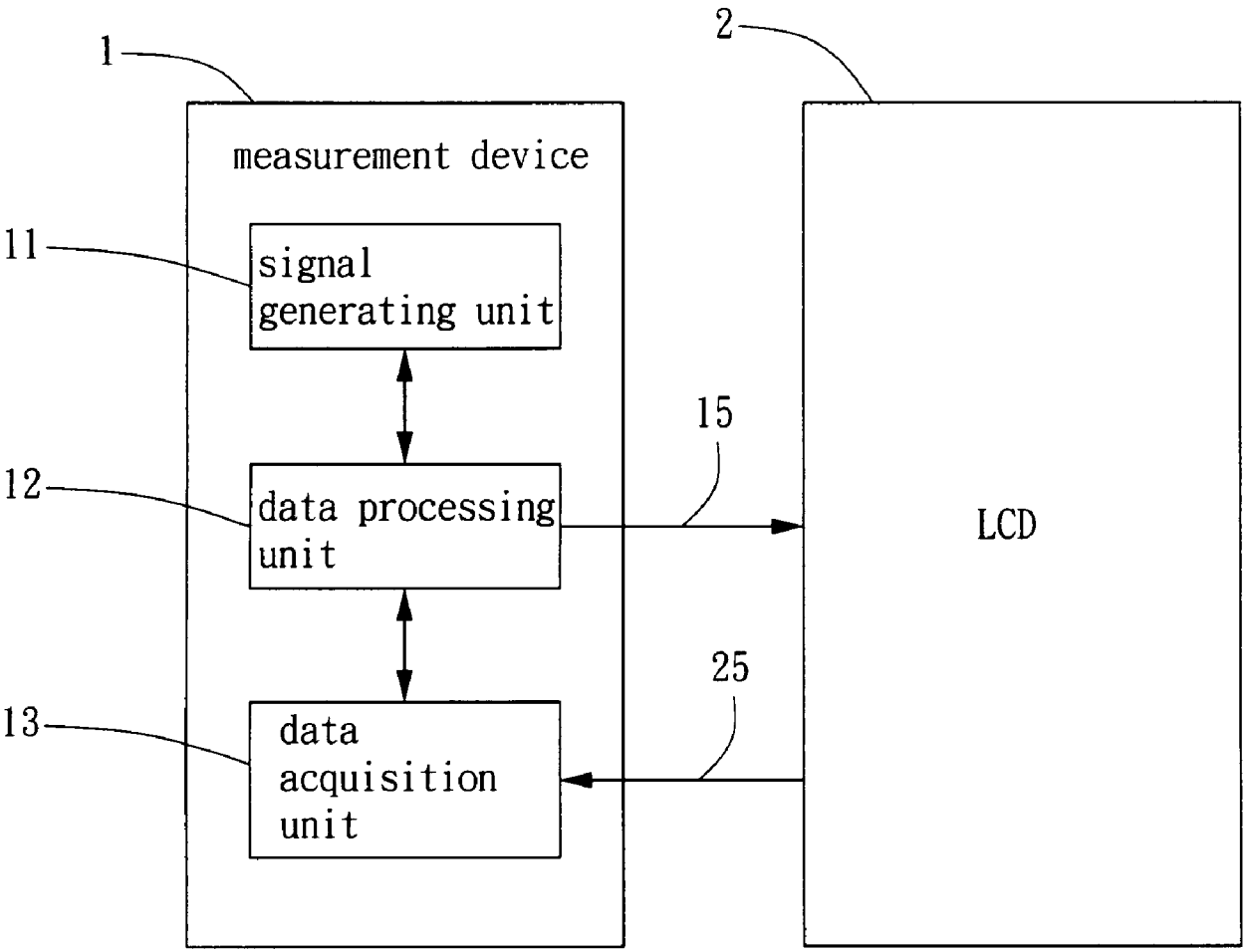
FIG. 1 is a functional block of a measurement device for measuring the gray-to-gray response time according to one preferred embodiment of the present invention.

Please refer to FIG. 1, which is a functional block of a measurement device for measuring the gray-to-gray response time according to one preferred embodiment of the present invention. The measurement device 1 comprises a signal generating unit 11, a data processing unit 12 and a data acquisition unit 13. The measurement device 1 is capable of measuring the transition time from a tested picture to another of an LCD 2.

To begin with, the signal generating unit 11 generates a video signal comprising a synchronous message and transmits the video signal to the data processing unit 12. The synchronous message is a vertical synchronous signal. The video signal is determined by the user to provide at least two different gray levels G1 and G2 for a tested picture. Then, the data processing unit 12 records the synchronous message contained in the video signal and transmits a signal 15 comprising information of the tested picture to the LCD 2 according to the video signal, so as to control the LCD 2 to generate a tested picture having a gray level G1. Meanwhile, the LCD 2 generates an optic signal 25 corresponding to the gray level G1. The optic signal 25 is the light from the screen of the LCD 2. When the displayed picture is switched from the tested picture having the gray level G1 to another tested picture having a gray level G2, the luminance of the optic signal 25 varies apparently. Since the initial time and the final time of each gray-to-gray response time interval in the transition of LCD luminance are precisely recorded, the data acquisition unit 13 uses the correct initial sampling time and the sampling rate to convert the optic signal 25 into a digital data according to the synchronous message recorded by the data processing unit 12 and a sampling command sent by the data processing unit 12. Therefore, the data processing unit 12 measures the gray-to-gray response time of the LCD 2 to achieve synchronous measurement according to the synchronous message and the digital data.

In one embodiment, the signal generating unit 11 is a computer coupled to the data processing unit 12 via an I/O interface. The signal generating unit 11 receives the synchronous message and the digital data regarding the gray-to-gray response time from the data processing unit 12 so as to calculate the gray-to-gray response time of the LCD 2. The signal generating unit 11 also determines the sampling rate at which the data acquisition unit 13 converts the optic signal 25 into the digital data so as to obtain the digital data more precisely.

Figure 2:
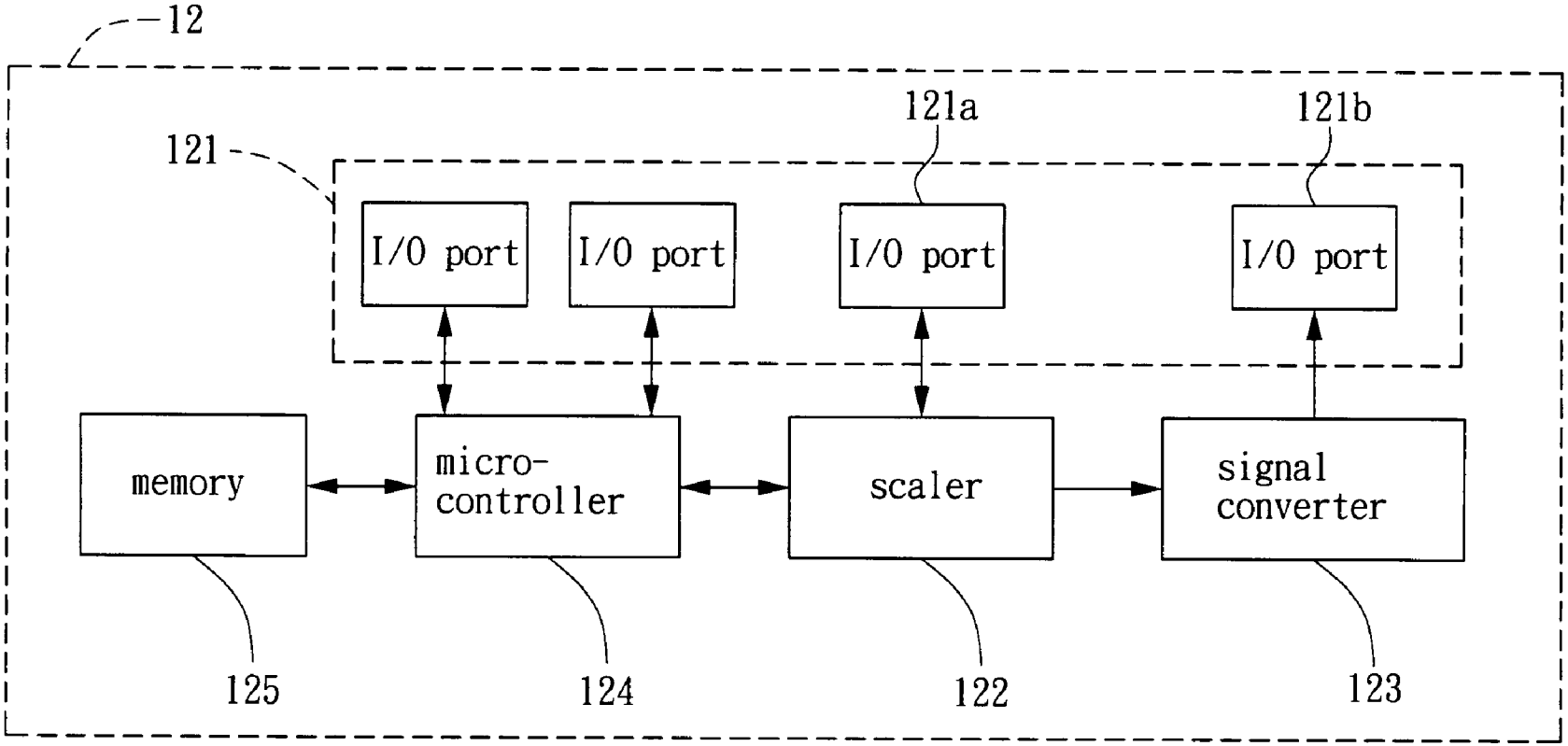
FIG. 2 is a functional block of a data processing unit of a measurement device for measuring the gray-to-gray response time according to one preferred embodiment of the present invention.

Please refer to FIG. 2, which is a functional block of a data processing unit of a measurement device for measuring the gray-to-gray response time according to one preferred embodiment of the present invention. The data processing unit 12 comprises: an I/O interface 121, a scaler 122, a signal converter 123, a micro-controller 124 and a memory 125. The I/O interface 121 comprises a plurality of I/O ports for signal inputting or outputting. For example, the I/O port 121*a* is provided with analog/digital inputs such as DVI input or VGA input and receives the video signal from the signal generating unit 11. The scaler 122 performs a scaling operation on the video signal so as to achieve a proper range of resolution. The signal converter 123 converts the video signal into an output signal. The video signal is a transition-minimized differential signal (TMDS), a low-voltage differential signal (LVDS) or a reduced-swing differential signal (RSDS). The video signal is transmitted through an I/O port 121*b* to the LCD 2 so as to control the displayed frame on the LCD 2 to switch from a tested gray picture into another.

While the data processing unit 12 receives a gray video signal from the signal generating unit 11, the micro-controller 124 stores a synchronous message of the video signal in the memory 125 and generates a sampling command capable of being synchronized with the synchronous message. The sampling command is transmitted through the I/O interface 121 to the data acquisition unit 13 so that the data acquisition unit 13 uses the correct initial sampling time and the sampling rate to convert the optic signal 25 into a digital data and then transmits the digital data back to the data processing unit 12. Moreover, if the signal generating unit 11 is a computer, the user sends a command through the computer to the micro-controller 124 so as to command the micro-controller 124 to adjust the sampling rate of the sampling command. The synchronous message and the digital data regarding the gray-to-gray response time are returned to the computer so that the computer calculates the gray-to-gray response time of the LCD 2.

Figure 3:
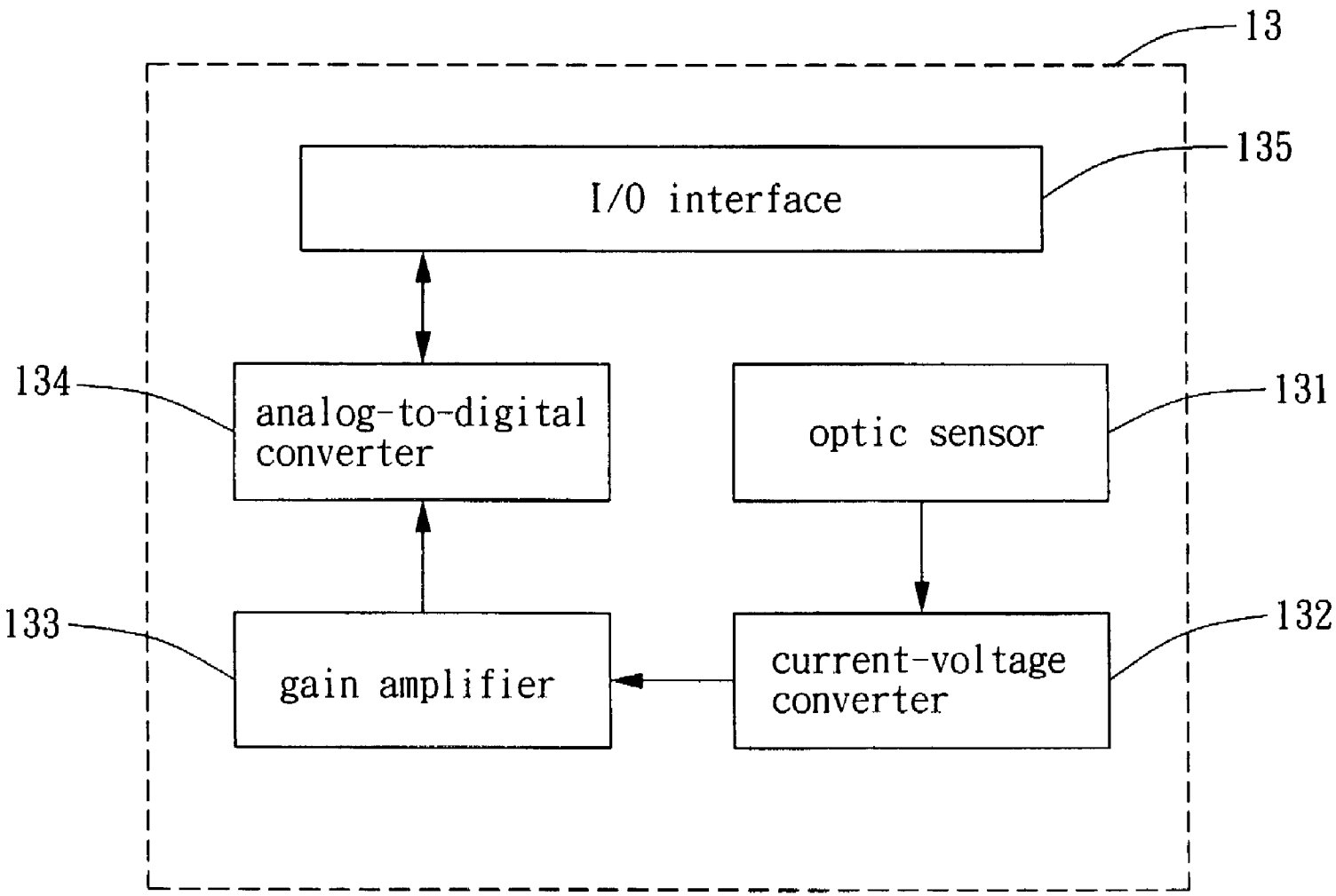
FIG. 3 is a functional block of a data acquisition unit of a measurement device for measuring the gray-to-gray response time according to one preferred embodiment of the present invention.

Please refer to FIG. 3, which is a functional block of a data acquisition unit of a measurement device for measuring the gray-to-gray response time according to one preferred embodiment of the present invention. In FIG. 3, the data acquisition unit 13 comprises an optic sensor 131, a current-voltage converter 132, a gain amplifier 133 and an analog-to-digital converter 134. The optic sensor 131 senses the optic signal 25 from the LCD 2 and converts the optic signal 25 into a current signal. The current-voltage converter 132 converts the current signal into a voltage signal. The gain amplifier amplifies 133 the voltage signal. The analog-to-digital converter 134 samples the voltage signal and obtain a digital data representing the LCD luminance variation according to the sampling command from the data processing unit 12. The digital data is then transmitted to the data processing unit 12 through the I/O interface 135.

Figure 4:
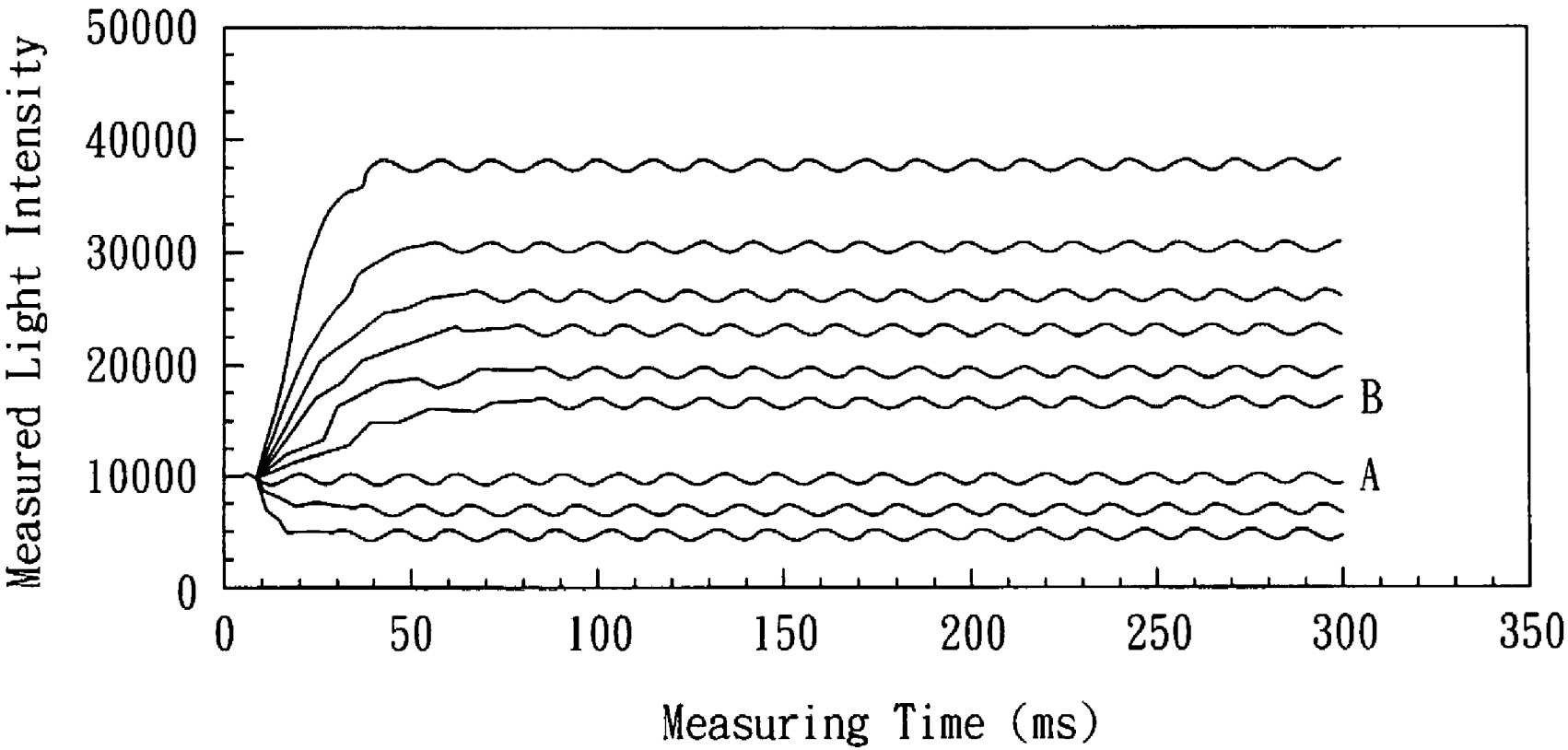
FIG. 4 is a graph showing the measured result of a measurement device for measuring the gray-to-gray response time according to one preferred embodiment of the present invention.

Please refer to FIG. 4, which is a graph showing the measured result of a measurement device for measuring the gray-to-gray response time according to one preferred embodiment of the present invention. The measured light intensity is 10000 (arbitrary units) when the gray level of the tested picture is 155. The measured light intensity varies with the change in gray level. For example, the measured light intensity varies from 10000 to 15000 when the gray level varies from 155 (line A) to 170 (line B). The time interval for the transition is several tens milliseconds (ms). The gray-to-gray response time is measured with the vertical synchronous message. In different ranges of gray level variation, a common initial time can be used for comparing various gray-to-gray response times.

Figure 5:
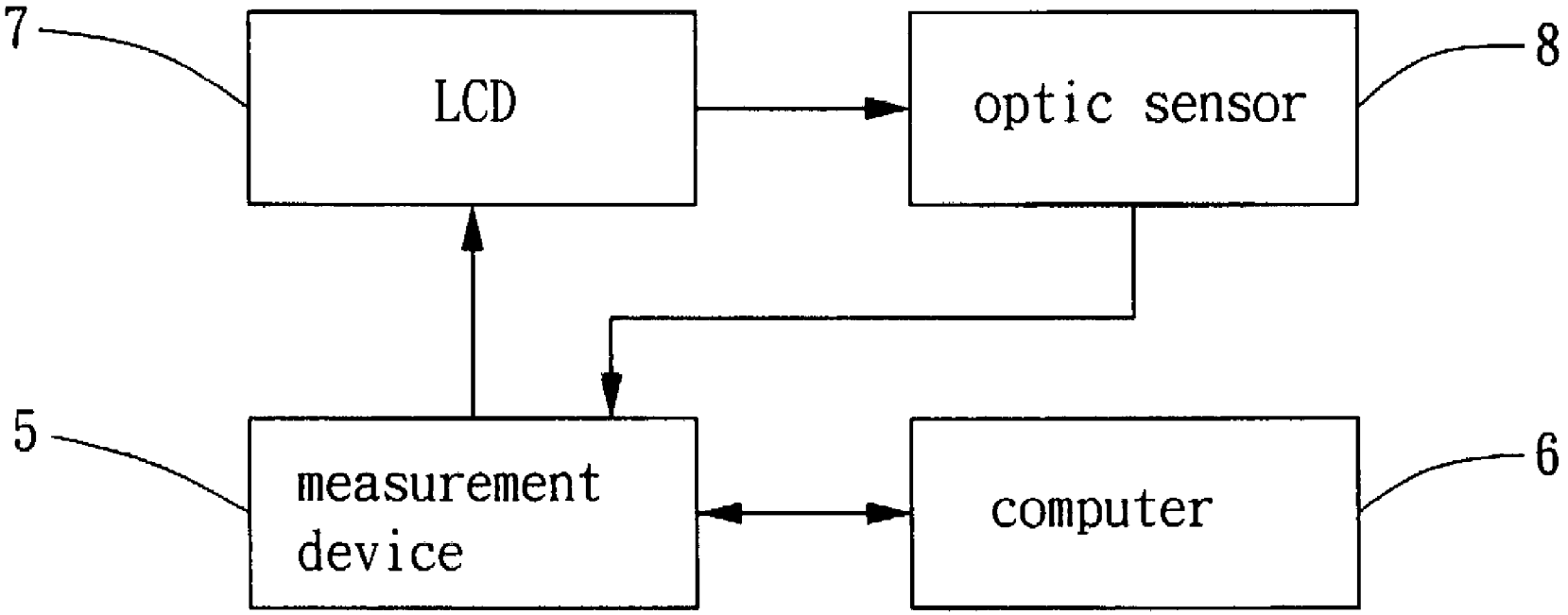
FIG. 5 is a functional block of a measurement device for measuring the gray-to-gray response time according to another preferred embodiment of the present invention.

In order to further integrate the aforementioned hardware units in the previous embodiment, the optic sensor 131 and the signal generating unit 11 can be excluded and the data processing unit 12 and the data acquisition unit 13 can be combined. Please refer to FIG. 5, which is a functional block of a measurement device for measuring the gray-to-gray response time according to another preferred embodiment of the present invention. The measurement device 5 receives a video signal comprising a synchronous message from a computer 6 and controls a LCD 7 so that the LCD 7 displays tested pictures with different gray levels according to the video signal comprising the synchronous message. The luminance of the optic signal from the LCD 7 changes with the change of tested pictures. An optical sensor 8 senses the optic signal and converts the optic signal into a current signal. The current signal is then transmitted to the measurement device 5 so that the measurement device 5 performs synchronous measurement of the gray-to-gray response time according to the synchronous message and the current signal from the optical sensor 8. The synchronous measurement is a vertical synchronous signal.

Figure 6:
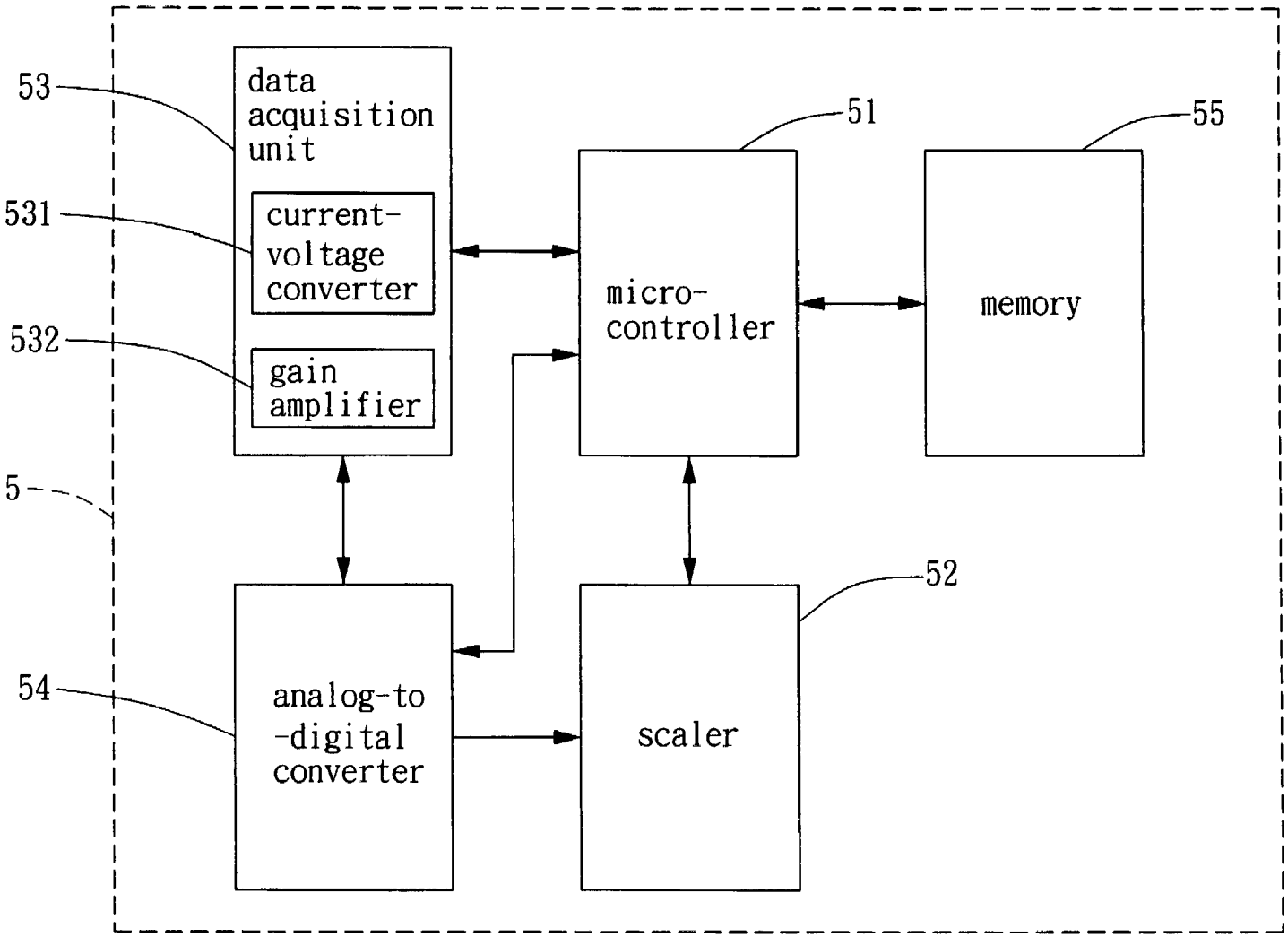
FIG. 6 is a functional block of a control unit of a measurement device for measuring the gray-to-gray response time according to another preferred embodiment of the present invention.

Please refer to FIG. 6, which is a functional block of a control unit of a measurement device for measuring the gray-to-gray response time according to another preferred embodiment of the present invention. The measurement device 5 comprises a micro-controller 51, a scaler 52, a data acquisition unit 53, an analog-to-digital converter 54 and a memory 55. The micro-controller 51 generates a sampling command capable of being synchronized with a synchronous message according to a video signal comprising the synchronous message from the computer 6. The scaler 52 performs a scaling operation on the video signal so as to control the LCD 7 to generate an optic signal. The data acquisition unit 53 processes a signal recording information of the optic signal so as to output an electric signal. The signal is a current signal into which the optic signal is converted by the optic sensor 8. The analog-to-digital converter 54 converts the electric signal into a digital data according to the sampling command so that the micro-controller 51 or the computer 6 measures the gray-to-gray response time of the LCD 7 according to the synchronous message and the digital data. The memory stores the synchronous message and the digital data.

More particularly, the data acquisition unit 53 further comprises a current-voltage converter 531 and a gain amplifier 532. The current-voltage converter 531 converts the current signal recording information of the optic signal into the voltage signal. The gain amplifier 532 amplifies the voltage signal.

Moreover, the micro-controller 51 adjusts the sampling rate of the sampling command so as to control the sampling time interval of the analog-to-digital converter 54 for converting the voltage signal into the digital data.

Accordingly, the present invention provides a measurement device for measuring the gray-to-gray response time. According to a video signal comprising a synchronous message, the measurement device obtains the initial time and the final time of each gray-to-gray response time interval in the transition of LCD luminance, so as to achieve synchronous measurement of the LCD gray-to-gray response time.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A measurement device for measuring a gray-to-gray response time of a liquid crystal display (LCD), the measurement device comprising:

a signal generating unit for generating a video signal comprising a synchronous message;

a data processing unit coupled to the signal generating unit for recording the synchronous message and controlling the LCD to generate an optic signal according to the video signal; and a data acquisition unit coupled to the data processing unit for converting the optic signal into a digital data so that the data processing unit measures the gray-to-gray response time of the LCD according to the synchronous message and the digital data.

2. The measurement device as recited in claim 1, wherein the synchronous message is a vertical synchronous signal.

3. The measurement device as recited in claim 1, wherein the data processing unit comprises:

an I/O interface for signal inputting or outputting;

a scaler for performing a scaling operation on the video signal; and a micro-controller for generating a sampling command capable of being synchronized with the synchronous message according to the synchronous message.

4. The measurement device as recited in claim 3, wherein the micro-controller adjusts a sampling rate of the sampling command according to the signal generating unit.

5. The measurement device as recited in claim 1, wherein the I/O interface comprises a plurality of I/O ports.

6. The measurement device as recited in claim 3, wherein the data processing unit further comprises a signal converter for converting the video signal into an output signal.

7. The measurement device as recited in claim 6, wherein the output signal is a transition-minimized differential signal.

8. The measurement device as recited in claim 6, wherein the output signal is a low-voltage differential signal.

9. The measurement device as recited in claim 6, wherein the output signal is a reduced-swing differential signal.

10. The measurement device as recited in claim 3, wherein the data processing unit further comprises a memory for storing the synchronous message and the digital data.

11. The measurement device as recited in claim 1, wherein the data acquisition unit comprises:

an optic sensor for sensing the optic signal and converting the optic signal into a current signal;

a current-voltage converter for converting the current signal into a voltage signal;

a gain amplifier for amplifying the voltage signal; and an analog-to-digital converter for converting the voltage signal into the digital data according to a sampling command.

12. A measurement device for measuring a gray-to-gray response time of a liquid crystal display (LCD), the measurement device comprising:

a micro-controller for generating a sampling command capable of being synchronized with a synchronous message according to a video signal comprising the synchronous message;

a scaler for performing a scaling operation on the video signal so as to control the LCD to generate an optic signal;

a data acquisition unit for processing a signal recording information of the optic signal so as to output an electric signal; and an analog-to-digital converter for converting the electric signal into a digital data according to the sampling command, wherein the microcontroller measures the gray-to-gray response time of the LCD according to the synchronous message and the digital data.

13. The measurement device as recited in claim 12, wherein the synchronous message is a vertical synchronous signal.

14. The measurement device as recited in claim 12, wherein the video signal comprising the synchronous message is generated from a computer.

15. The measurement device as recited in claim 12, wherein the signal recording information of the optic signal is generated from an optic sensor.

16. The measurement device as recited in claim 12, wherein the data acquisition unit comprises:

a current-voltage converter for converting the signal recording information of the optic signal into the electric signal; and a gain amplifier for amplifying the electric signal.

17. The measurement device as recited in claim 12, wherein the micro-controller adjusts a sampling rate of the sampling command.

18. The measurement device as recited in claim 12, further comprising a memory for storing the synchronous message and the digital data.

* * * * *